United States Patent [19]

Tolmie, Jr.

[11] 4,156,141

[45] May 22, 1979

[54] CORONA WIRE DAMAGE CONTROL RESISTOR

[75] Inventor: Robert J. Tolmie, Jr., Fairfield, Conn.

[73] Assignee: Pitney-Bowes, Inc., Stamford, Conn.

[21] Appl. No.: 869,504

[22] Filed: Jan. 16, 1978

[51] Int. Cl.[2] ..... H01T 19/04

[52] U.S. Cl. ..... 250/324; 250/315 R

[58] Field of Search ..... 250/324, 325, 326, 315; 361/2.3, 229, 230

[56] References Cited

U.S. PATENT DOCUMENTS

| | | | |
|---|---|---|---|
| 3,554,161 | 1/1971 | Blanchette | 250/325 |
| 3,604,925 | 9/1971 | Snelling et al. | 250/326 |
| 3,760,229 | 9/1973 | Silverberg | 361/213 |

*Primary Examiner*—Bruce C. Anderson

*Attorney, Agent, or Firm*—Martin D. Wittstein; William D. Soltow, Jr.; Albert W. Scribner

[57] ABSTRACT

Damage to corona wires in electrophotocopy machines is controlled by connecting an electrical resistance in series between the corona wire power supply and the corona wire. The impedance of the resistance is determined in accordance with formulae and empirical methods in order to control potential arcing damage due to resistive heating and ion bombardment.

15 Claims, 4 Drawing Figures

CORONA WIRE DAMAGE CONTROL RESISTOR

BACKGROUND OF THE INVENTION

This invention relates to an improvement in corona charging units for electrophotocopy machines and more particularly to a damage control resistor for dissipating excess corona power supply energy when an arc occurs and for quickly extinguishing the arc in order to prevent a corona wire from becoming damaged due to ion bombardment.

Corona charging units can perform a number of essential functions in the electrophotocopying process. That process includes the steps of charging a photosensitive member, exposing the charged member to an original to form a latent electrostatic image of the original on the photosensitive member, and developing the latent image. In plain paper copiers, the latent image is usually developed on the photosensitive member and the developed image is transferred to a plain paper copy sheet after which the photosensitive member is cleaned before another copy is made. Corona charging units are commonly used to initially charge the photosensitive member, to transfer the developed image to a copy sheet, and to discharge any residual charge on the photosensitive member so that it can be cleaned of untransferred developer before another copy cycle is begun.

Such corona charging units comprise an elongated fine wire that is maintained at a high electrical potential. The wire is supported on insulating blocks and is positioned between a grounded backing plate (shield) and the photosensitive member. A power supply with an output capacitance and capable of generating a high electrical (corona) potential is electrically connected to the corona wire. The power supply raises the potential of the corona wire to several thousand volts in order to generate an effective electric field in the vicinity of that portion of the photosensitive member that passes by the corona wire.

An unresolved and recurring problem for copy machine users is the breaking of corona wires. Broken corona wires must be replaced before the copy machine can resume production. Although replacement or repair of the corona wire can be easily made, temporary loss of the use of the copy machine and the repair thereof cost the user both time and money.

Until now it has been assumed that the cause of corona wire breakage was due to one or more of a number of factors that were beyond control. Such factors were believed to include arcing between the corona wire and the shield (or the photosensitive member which has a grounded, conductive backing), corrosion, vibration, and high mechanical stress in the corona wire which is tautly mounted between the insulating blocks. Regarding corona arcing, in general, it has been suggested that an external series resistor can prevent arcing. See, Leonard D. Loeb, *Electrical Coronas,* page 513 (1965). Moreover, there are a number of patents that describe corona charging units and show a resistor connected in series with the corona wire; see, e.g. U.S. Pat. Nos. 2,777,957 (Walkup), 2,868,989 (Haacke), 2,856,533 (Rosenthal), 3,604,925 (Snelling), 3,557,367 (Roth), 3,675,011 and 3,760,229 (both Silverberg). Furthermore, some types of commercially available power supplies have a resistor at the output terminal that is connectable in series with the corona wire of the corona charging device while other types have no such resistor. Nevertheless, experience with either type of supply has shown that corona wires will arc and break. Hence, if arcing is a cause of corona wire damage, a series resistor did not appear to be a solution to the problem.

INTRODUCTION AND SUMMARY

It has been discovered that corona wires can be damaged and broken as a result of at least one of two distinct arcing phenomena. One phenomenon is resistive heating of the corona wire and the other phenomenon is bombardment of the corona wire by ions. The invention described herein provides for a damage control resistor that is large enough to dissipate a significant portion of the resistive heat and still small enough to quickly extinguish the arc and thereby terminate ion bombardment of the corona wire.

When the problem of corona wire breakage was first investigated, only the first of the two phenomena were believed to be a cause of the breakage. Accordingly, it was originally believed that arcing heated the corona wire and softened it. The corona wire is always under a high mechanical stress since it is tautly mounted between its insulating blocks. During an arc, a larger than normal current heats the wire, the wire softens and ultimately breaks under the mechanical stress. It has also been observed that some arcs will melt or vaporize the corona wire, depending upon the position of the arc, the energy stored in the power supply capacitor and the electrical properties and mechanical dimensions (especially the diameter) of the wire itself. In theory, the corona wire could be prevented from breaking by reducing the corona wire current and one means for reducing the current would be a resistance inserted in series between the corona wire power supply and the corona wire.

The energy stored in the output capacitance of the power supply will be dissipated in the series resistance and the corona wire resistance which is relatively small in comparison with the series resistance. Thus, there should be little energy dissipated in the corona wire for very high series resistances and corona wire breakage should be eliminated or minimized by placing a large resistance in series with the corona wire.

The foregoing theory was tested by inserting increasingly larger resistances in series with a corona wire. The results were surprisingly contrary to those that were expected. Corona wires not only continued to break, but as the series resistance was increased, the corona wires broke sooner; for very large resistances (e.g., 75KΩ and up), the corona broke almost instantaneously.

Hence, based on the foregoing, one might conclude that arcing and subsequent corona wire breaking would occur with or without a series resistor, and would occur sooner for increasingly larger values of series resistances. However, it was also observed that the time it took for a corona wire to break became shorter as the series resistance became larger. That observation led to another hypothesis that a second, unrelated phenomenon was occurring when the series resistance was very large. It was subsequently discovered that the large resistance combined with the output capacitance of the power supply to yield a relatively long RC discharge time constant. So, during an arc, it took a long time for the output voltage of the power supply to decay. Such relatively long-lived arcs are believed to be a cause of ion bombardment that erodes the corona wire until it breaks.

It is now believed that ion bombardment occurs in the following manner A charged corona wire emits electrons that move toward the grounded shield. In their passage toward the shield, the electrons ionize some of the molecules of air that are in the path of the electrons. A portion of the ions migrate toward and impact the corona wire. Upon impact, the ions liberate a large number of electrons which in turn produce more ions, some of which likewise impact the corona wire to liberate still more electrons. It is believed that perhaps one hundred times as many electrons are liberated by ion impact than are liberated by normal corona wire emission. Under normal conditions most of the ions diffuse into the air and the few ions that impact upon the corona wire cause little damage. However, when an arc occurs, a large number of air molecules are ionized. Unless the arc is extinguished in a short period of time, an ion bombardment will start eroding the corona wire until it breaks.

Arcs are extinguished by dropping the voltage across the corona wire below the corona generating potential. The voltage to the corona is supplied by a high voltage dc power supply. The output voltage of the supply is delivered across a capacitor. When an arc occurs, the capacitor is effectively shorted out and begins to discharge. The time it takes for the capacitor to discharge its voltage to below the corona generating potential is critical. If the discharge time is too long, the arc will persist and runaway ion bombardment will occur. That discharge time is lengthened whenever a series resistance is introduced between the power supply and the corona wire.

Hence, the solution to the problems caused by lack of any series resistance and too large a series resistance lies in choosing a series resistance small enough to result in a relatively short discharge time constant but still large enough to limit the temperature rise of the corona wire.

Accordingly, it is an object of this invention to provide a means and method for preventing corona wires from breaking when either of the aforementioned arcing phenomena occur.

It is another object of this invention to provide a resistance in series between a corona wire power supply and a corona wire, said resistance having an impedance large enough to dissipate excess power supply energy and small enough to terminate an arc before ion bombardment can damage the wire.

DETAILED DESCRIPTION

Figure 1:
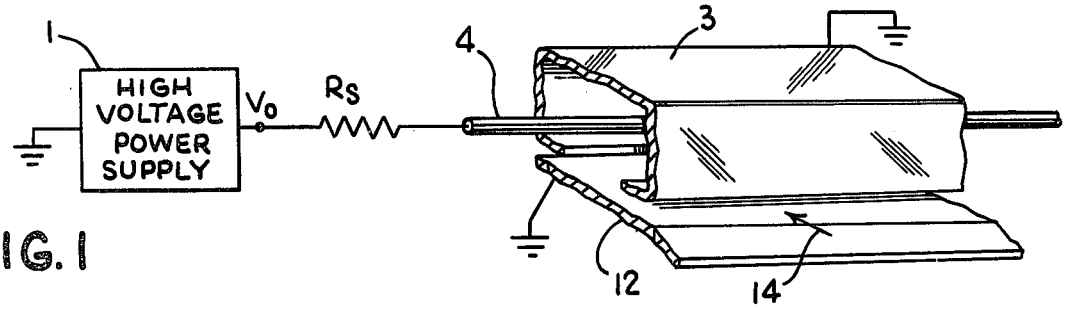
FIG. 1 represents a broken perspective view of a corona charging unit that is shown coupled to a schematic representation of a corona power supply and a series damage control resistor.

With reference to FIG. 1, a series damage control resistor Rs is shown electrically connected between a high voltage corona power supply 1 and a corona charging unit 10. The corona charging unit 10 comprises an electrically grounded backing plate or shield 3 that partially encloses a corona wire 4. The corona wire 4 is mounted inside the shield 3 between insulating blocks (not shown) that are located one at each end of the shield 3. A photosensitive member 12 is disposed in front of the opening in the shield 3 and spaced from the corona wire 4.

The output voltage of the power supply 1 is a constant, high dc potential Vo. The output voltage Vo may be either positive or negative depending upon the nature of the photosensitive member 12 and upon the function of the corona charger. An initial charging corona and a transfer corona will usually have the same polarity and a cleaning or discharge corona will usually have a polarity opposite to the initial charging corona. The power supply output voltage Vo is coupled to the corona wire 4 through series damage control resistor Rs. When Vo is high enough, the air around the corona wire is ionized. The ions move toward the electrically neutral grounded shield 3, under the influence of an electric field that surrounds the corona wire. Portions of a photosensitive member 12 are sequentially exposed to that field as the photosensitive member moves past the corona wire 4. The photosensitive member 12 comprises an upper photosensitive surface and a lower conductive grounded surface. The photosensitive member 12 moves past the corona charging unit 10 in the direction indicated by the arrow 14 with the upper photosensitive surface juxaposed to the corona wire 4.

The movement of ions from the proximity of the corona wire 4 to the corona shield 3 is known as corona current. Under normal conditions, this current is small and of the order of several hundred microamperes so that the electrical connection between the corona wire 4 and the shield 3 normally functions like an open circuit. However, when a spark or arc appears between the corona wire and the backing plate, the arc acts like a short circuit between the highly charged corona wire 4 and the grounded backing plate 3. Such a short circuit causes a substantial increase in corona current that in turn causes a high current to flow in the corona wire 4. In a corona charging device without a resistor Rs, the current carried in the corona wire during arcing is dissipated as heat and for very high corona wire currents the amount of heat that is generated is damaging to the corona wire. In the invention, the resistor Rs dissipates enough of the damaging energy to keep the corona wire from melting or vaporizing or from softening and slacking. When a corona wire slackens a portion of the wire may move closer, toward the shield 3 which can increase the corona wire current.

Figure 2:
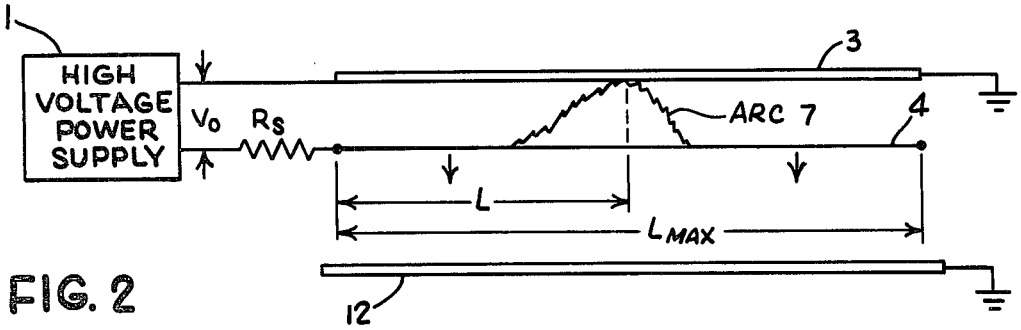
FIG. 2 is an elevation view of the corona charging unit of FIG. 1.

The invention is best explained with reference to FIGS. 2 and 3. In FIG. 2 there is shown a representation of the corona wire 4 that is disposed between a grounded backing plate 3 on one side and a photosensitive member 12 on the other side. There is also shown an arc 7 between the corona wire 4 and the shield 3 occurring at a length L along the corona wire 4 whose total length is Lmax.

An arc may also occur between the corona wire 4 and the grounded backing of the photosensitive member 12. When the latter occurs, the photosensitive member is usually punctured and its usefulness impaired.

Figure 3:
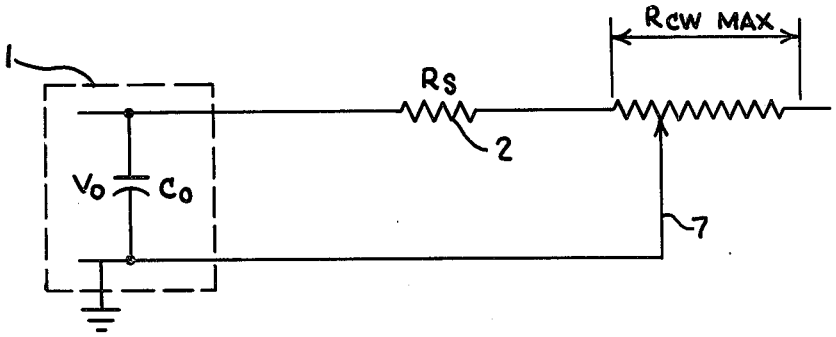
FIG. 3 is a schematic representation of the corona power supply, the series damage control resistor, and the corona wire resistance at an arcing point.

A schematic representation of the elements of FIG. 2 is shown in FIG. 3. High voltage dc supplies typically have an output capacitor across the output terminals of the supply and the high voltage dc power supply 1 has a capacitor Co at its output and the voltage Vo appears across output capacitor Co. One end of capacitor Co is grounded. A damage control resistance Rs electrically connected in series between the other end of output capacitor Co and the corona wire 4. The resistance of the corona wire up to the arc is represented by the potentiometer 8 comprising a resistance Rcw and a wiper arm 7. The wiper arm 7 represents the arc and Rcw represents the resistance of the corona wire 4 up to the position of the arc at the distance L. Rcmax is the total resistance of the corona wires for its full length, Lmax.

For practical purposes, the arc has no resistance and the resistances of the conductors that interconnect the capacitor Co, resistor Rs and the corona wire 4 are so small in comparison to Rs and Rcw that such conductor resistance can be ignored. Accordingly, the total resistance in circuit of FIG. 3 is the sum of Rs and Rcw, i.e., $$Rt = Rs + Rcw \qquad \text{Eq. 1}$$

When an arc occurs, the energy stored in the capacitor Co will be dissipated in the total resistance Rt and the amount of energy dissipated by any one element (Rs or Rcw) is proportional to the resistance of that element, i.e., $$Et = CoVo^2/2 = Es + Ecw \qquad \text{Eq. 2}$$

where Et is the total energy stored in capacitor Co charged to the voltage Vo, Es is the portion of Et dissipated by Rs and EEcw is the portion of Et dissipated by Rcw.

Since the portion of energy dissipated by a resistive element is proportional to the resistance of the element, then $$(Rcw/Rt) = (Ecw/Et) \qquad \text{Eq. 3}$$

The foregoing equation can be rewritten to show that $$Ecw = (Rcw\ Et/Rt) \qquad \text{Eq. 4}$$

Recalling from Eq. 1 that Rt=Rcw+Rs, then $$Ecw = \frac{Rcw\ Et}{Rcw + Rs} \text{ and from Eq. 2 that} \qquad \text{Eq. 5}$$

$$Et = \frac{CoVo^2}{1}, \text{ then}$$

$$Ecw = \frac{Rcw\ CoVo^2}{2(Rcw + Rs)} \qquad \text{Eq. 6}$$

Since the output voltage Vo is a constant, from equation 6 it is apparent that the only variables influencing the amount of energy dissipated by the corona wire are Rcw and Rs, i.e. the length of the corona wire 3 up to the arc and the series resistor, respectively.

The temperature rise in an arcing corona wire is dependent upon the location of the arc along the length of the wire. For arcs that occur close to the connection to the power supply, only a relatively small length of the whole corona wire is available to dissipate the energy discharge from the power supply capacitor. It follows that, for all other conditions being constant, when an arc occurs at or near the end of the corona wire closest to the power supply, the energy dissipated over such a short segment of wire will cause the largest temperature rise in the wire. Likewise, as an arc occurs further along the length of the wire, the corresponding temperature rise will lessen as the length increases until a minimal temperature rise occurs at the end of the wire farthest from the power supply.

Hence, the temperature rise ΔT is inversely proportional to Rcw and so ΔT will be a maximum when Rcw is a minimum, i.e., ΔT will approach its maximum value when an arc occurs at the end of the corona wire that is closest to the series resistor Rs, i.e., when Rs→0. Accordingly, by choosing a large enough value of Rs, the maximum energy dissipated by corona wire 4 can be held to an amount small enough to prevent the corona wire 4 from being damaged.

The amount of energy supplied to the corona wire in the form of heat can be computed from the following formula.

$$E\ \text{heat} = SWL\Delta T/0.2389 \qquad \text{Eq. 7}$$

where S is the specific heat in calories/gram−C, W is the weight per unit length in centimeters, L is the length of the wire in centimeters, ΔT is the rise in temperature of the wire above the ambiant wire temperature (a predetermined, damage preventing value, such as 10° C.) and 0.2389 is a conversion factor from Joules to calories.

In order to prevent the wire from damage, the amount of energy dissipated in the corona wire 4, Ecw, should be equal to or less than the energy that would cause the predetermined temperature rise. Hence, $$Ecw \leqq E\ \text{heat} \qquad \text{Eq. 8}$$

and substituting the value for Ecw from Eq. 5 into Eq. 8 yields $$Rcw\ Et/Rcw + Rs \leqq E\ \text{heat} \qquad \text{Eq. 9}$$

and by solving the foregoing for Rs, then $$Rs \geqq Rcw\left[\frac{Et}{E\ \text{heat}} - 1\right] \qquad \text{Eq. 10}$$

Recalling from Eq. 7 that E heat=$SWL\Delta T/0.2389$ then $$Rs \geqq \frac{0.2389\ EtRcw}{SWL\Delta T} - Rcw \qquad \text{Eq. 11}$$

Since Et=CoVo/2, then $$Rs \geqq \frac{.2389\ CoVo^2Rcw}{2 \times \Delta T \times S \times W \times L} - Rcw \qquad \text{Eq. 12}$$

For a given corona wire, the value of Rcw is the product of its length (L) and its resistance per unit length, a constant Kr, i.e.

$$Rcw = KrL \qquad \text{Eq. 13}$$

Substituting Eq. 13 into the fractional expression of Eq. 11 yields $$Rs \geqq \frac{0.2389\ ET\ KrL}{\Delta T \times S \times W \times L} - Rcw \qquad \text{Eq. 14}$$

Since L appears in both the numerator and denominator of the fraction, the L's cancel out. By considering the most potentially damaging case, i.e., where an arc occurs near the power supply and Rcw→0, then the value for Rs is given as follows:

$$Rs \geqq \frac{0.2389\ ET\ Kr}{\Delta T \times S \times W} \quad \text{Eq. 15}$$

For example, a typical corona unit consists of a 60 cm tungsten wire having a specific heat (S) of 0.034 cal/g−° C. The diameter of the wire is 0.005 cm, its mass per unit length is 0.0003885 gram/cm and its resistance per unit length (Kr) is 0.02853Ω/cm. A typical power supply has an output voltage Vo of 8,300 volts across an output capacitor Co of $0.0125 \times 0.10^{-6}$ farads. Assuming that it is desired to limit the temperature rise of the corona wire to 10° C., then for such a corona unit and power supply, the minimum resistance Rs to prevent corona wire breakage is determined as follows.

The total energy stored in the capacitor Co is:

$$Et = \frac{CoVo^2}{2} = \frac{0.0125 \times 10^{-6} \times (8300)^2}{2} \quad \text{Eq. 16}$$

Solving For Rs with Eq. 15 yields:

$$Rs \geqq \frac{0.2389\ ET\ Kr}{\Delta T \times S \times W} \quad \text{Eq. 17}$$

$$Rs \geqq \frac{0.2389\ (0.4305)\ (\ )0.28353)}{(10)\ (0.034)\ (0.0003885)}$$

$$Rs \geqq 221.8\Omega$$

The foregoing analysis and example indicates that all resistances greater than Rs=222Ω would prevent corona breakage. The foregoing also indicates that any large series resistance, even one megohm would prevent corona breakage. However, as pointed out above, it has been further discovered that corona breakage occurs with such extra large resistances, especially when high negative voltages are applied to the corona wire 4. It is believed that such extra large resistance lengthens the discharge RC time constant of capacitor Co to such a long time that a large number of ions are created by the corona arc.

When a corona wire 4 is negatively charged and an arc occurs, the arc ionizes air molecules between the corona wire 4 and the shield 3 and between the corona wire 4 and the photosensitive member 12. These ions are positively charged and possess a high energy that enables them to move rapidly toward the corona wire 4 and impact it in a time on the order of tens of microseconds. The impact of the positive ions on the negatively charged corona wire 4 blasts atoms off the corona wire 4 and liberates a number of free electrons while in turn creates more high energy positive ions that further bombard the corona wire 4. Hence, if an arc is not quickly extinguished, a large number of atoms will be blasted from the corona wire thereby causing it to break.

The length of time it takes to extinguish an arc is dependent upon the total resistance, Rt, and the power supply output capacitor, Co. It will be recalled that an arc function like a short circuit. When an arc occurs, the voltage across the capacitor Co begins to decay. The time (t) it takes for the initial capacitor voltage (Vo) to decay to a voltage (Ve) where the arc is extinguished can be calculated from the following formula:

$$t = Rt\ Co\ \ln\ (Ve/Vo) \quad \text{Eq. 18}$$

It has been determined that the decay time, t, should be less than a predetermined time in order to prevent the corona wire from breaking under the ensuing ion bombardment. Accordingly, the foregoing equation can be solved for a total resistance (Rt) that will limit the decay time to such a predetermined time as follows:

$$Rt = \frac{t}{Co\ \ln\ (Ve/Vo)} \quad \text{Eq. 19}$$

It is readily apparent that ion bombardment will be most potentially damaging when the arc occurs at the end of the corona wire that is farthest from the power supply. At that position, the full length of the corona wire contributes its resistance toward prolonging the arc. Hence, the value of Rs that would keep Rt within the range necessary to minimize ion bombardment damage is the difference between the value of Rt given by Eq. 19 and the resistance of the entire corona wire, Rcw, or $$Rs = Rt - Rcw \quad \text{Eq. 20}$$

$$= \frac{t}{Co\ \ln\ (Ve/Vo)} - Rcw$$

It will be recalled that Rt=Rcw+Rs and when Rt is relatively small, the arc is quickly extinguished and relatively few high energy positive ions have time to bombard the corona wire 4. However, no matter how small Rt is, some ions will bombard the corona wire 4 and thereby cause some damage. Accordingly (since Rcw is fixed), the value of Rs should be chosen as small as possible and the diameter of the corona wire 4 should be as large as possible to give it strength and prolong its life.

Although Egs. 18–20 provide a way of calculating the maximum value of Rs, it is also possible to empirically arrive at a value of Rs that will satisfactorily minimize damage to a given corona wire. The latter is done by placing a corona wire in an altitude chamber and varying the value of Rs until the corona wire begins to glow red at the point of the arc, at the highest altitude where it is anticipated that the corona wire will be used. The red glow is indicative of ion bombardment and as the resistance R increases, the glow becomes redder and then whitens whereupon the corona wire breaks. One should then compare the empirical value of Rs with the calculated value of Rs that will minimize the temperature rise (Eq. 14). If the empirical value of Rs is greater than the calculated value, then any resistance between the two values is acceptable, and the calculated value is the preferred one. However, if the empirical value is greater than the calculated value, one should revaluate the acceptable temperature rise or change other parameters, such as wire diameter, the capacitance of Co, the material of the corona wire, the corona voltage, etc., all of which would be readily apparent to one skilled in the art in order to settle on a corona charging unit and power supply that will minimize cornona wire breakage.

For the typical corona wire mentioned above, it was empirically determined that a series resistance of 5 KΩ resulted in the beginning of a red glow on the corona wire at the point of the arc. Such a series resistance yielded a capacitor discharge time constant of $6.25 \times 10^{-5}$ seconds. Since it takes approximately five time constants for an arc to extinguish itself, the foregoing indicates that a decay time of less than $31.25 \times 10^{-5}$ seconds is needed in order to prevent the onset of observable ion bombardment. Hence, the previously calculated series resistance value of 222 Ω is preferred and any resistor greater than 222 Ω but less than 5 KΩ would be acceptable.

Figure 4:
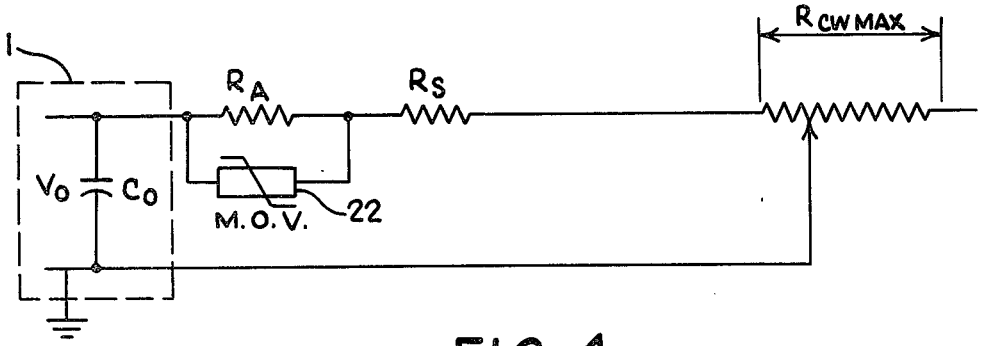
FIG. 4 is a schematic representation of an another embodiment of this invention.

When the arc persists for a long time it is believed that the ions become unstable and cause an autocatalytically increasing corona current that melts or vaporizes the wire. Although extra large series resistors are normally to be avoided, under certain environmental conditions it is necessary to decrease the corona potential by adding a resistor in series between the power supply and the corona wire. In such cases the embodiment of the invention shown in FIG. 4 may be used.

There is shown another resistor Ra, connected in series with a normal energy limiting resistor Rs. A normally nonconductive metal oxide varistor (MOV) 22 is coupled in parallel across Ra. The MOV 22 acts as an arc sensing means so that when an arc occurs and the corona current increases, the voltage drop across Ra exceeds the threshold voltage of MOV 22. When that occurs, the MOV 22 becomes conductive, thereby shorting oout Ra. That will substantially reduce the impedance in series with the capacitor Vo, thereby shortening the RC discharge time constant and preventing the corona current from autocatalytically increasing.

With the benefit of the foregoing disclosure, those skilled in the art will recognize that the tolerable decay time for an arc on a given corona wire and the amount of energy that can safely be dissipated by a corona wire will vary depending upon many factors. Such factors include, but are not limited to, the gap between the corona wire and the grounded surface to which the arc travels, the diameter of the corona wire, the material used to make the wire, the corona charging potential, environmental conditions (altitude, humidity) and the characteristics of the power supply, especially its output capacitance. Accordingly, such obvious modifications to the physical parameter of the corona wire and its attachments are deemed within the spirit and scope of the invention as expressed in the following claims.

In addition to the foregoing embodiments, those skilled in the art will recognize that they may practice the invention by incorporating it directly into a power supply, or into a corona charging unit or by connecting an appropriate series resistor between a power supply and a corona charging unit.

Although the invention has been described with a certain degree of particularity, it is understood that the present disclosure has been made as an example of the preferred and alternate embodiments and that changes in the details of construction and the combination and arrangement of elements may be resorted to without departing from the spirit and scope of the following claims.

What is claimed is:

1. In an electrophotocopy machine, a damage control resistor electrically connected between a corona wire and an output capacitance of a corona power supply, said damage control resistor having a resistance Rs at least as large as a mimimun resistance Rs min for thermally dissipating a predetermined amount of energy when an arc occurs and not greater than a maximum resistance Rs max for quickly discharging the output capacitance in order to extinguish the arc, wherein:

a. the minimum resistance Rs min is derived from the formula $$Rs\ \min \geqq Rcw\left[\frac{Et}{Ed}-1\right]$$

where Rcw is the impedence of the corona wire, Et is the electrical energy of the source, and Ed is the predetermined amount of energy that would damage the corona wire and, b. the maximum resistance Rs max is derived from the formula $$Rs\ \max \leqq \frac{t}{Co\ \ln\ (Ve/Vo)} - Rcw$$

where t is the time within which an arc must be extinguished in order to prevent damage to the corona wire, Co is the output corona capacitance of the power supply, Vo is the output corona voltage of the power supply and Ve is the voltage at which an arc will be extinguished.

2. The invention of claim 1 wherein discharge time, t, is equal to or less than $10^{-5}$ seconds.

3. The invention of claim 1 wherein the maximum ohmic impedance of said damage control resistor is the ohmic impedance at which the corona wire begins to glow red at the point of said arc.

4. The invention of claim 1 further comprising a second resistor electrically connected in series with said damage control resistor and a normaly open circuit arc sensing means connected in parallel with said seond resistor and responsive to an arc for closing said normally open circuit.

5. The invention of claim 1 wherein said arc sensing means is a metal oxide varistor.

6. A power supply for charging a corona wire to its corona potential, said power supply comprising an output capacitance, a source of electrical energy coupled across said output capacitance, and a damage control resistor connected to said output capacitance and connectable to said corona wire, said damage control resistor having a resistance Rs at least as large as a minimum resistance Rs min for thermally dissipating a predetermined amount of energy when an arc occurs and not greater than a maximum resistance Rs max for quickly discharging the output capacitance in order to extinguish the arc, wherein a. the minimum resistance Rs min is derived from the formula $$Rs\ \min \geqq Rcw\left[\frac{Et}{Ed}-1\right]$$

where Rcw is the impedence of the corona wire, Et is the electrical energy of the source, and Ed is the predetermined amount of energy that would damage the corona wire, and b. the maximum resistance Rs max is derived from the formula $$Rs\ \max \leqq \frac{t}{Co\ \ln\ (Ve/Vo)} - Rcw$$

where t is the time within which an arc must be extinguished in order to prevent damage to the corona wire, Co is the output capacitance of the power supply, Vo is the output corona voltage of Co power supply and Ve is the voltage at which an arc will be extinguished.

7. The invention of claim 6 wherein discharge time, t, is equal to or less than $10^{-5}$ seconds.

8. The invention of claim 6 wherein the maximum ohmic impedance of said damage control resistor is the ohmic impednace at which the corona wire begins to glow red at the point of said arc.

9. The invention of claim 6 further comprising a second resistor electrically connected in series with said damage control resistor and normally open circuit arc sensing means connected in parallel with said second resistor and responsive to an arc for closing said normally open circuit.

10. The invention of claim 6 wherein said arc sensing means is a metal oxide varistor.

11. A corona charging unit for an electrophotocopy machine for generating an electrostatic field in the vicinity of a photosensitive member, said corona charging unit comprising a corona wire chargeable to a corona potential, and an electrically grounded shield, spaced from said corona wire, and a damage control resistor electrically connected to said corona wire and connectable to an output capacitance of a corona power supply, said damage control resistor having a resistance Rs at least as large as a minimum resistance Rs min for thermally dissapating a predetermined amount of energy when an arc occurs and not greater than a maximum resistance Rs max for quickly discharging the output capacitance in order to extinguish the arc, wherein a. the minimum resistance Rs min is derived from the formula $$Rs\ \min \geqq Rcw\left[\frac{Et}{Ed} - 1\right]$$

where Rcw is the impedance of the corona wire, Et is the electrical energy of the source, and Ed is the predetermined amount of energy that would damage the corona wire, and b. the maximum resistance Rs max is derived from the formula $$Rs\ \max \leqq \frac{t}{Co \ln (Ve/Vo)} - Rcw$$

where t is the time within which an arc must be extinguished in order to prevent damage to the corona wire, Co is the output capacitance of the power supply, Vo is the output corona voltage of the power supply and Ve is the voltage at which an arc will be extinguished.

12. The invention of claim 11 wherein discharge time, t, is equal to or less than $10^{-5}$ seconds.

13. The invention of claim 11 wherein the maximum ohmic impedance of said damage control resistor is the ohmic impednace at which the corona wire begins to glow red at the point of said arc.

14. The invention of claim 11 further comprising a second resistor electrically connected in series with said damage control resistor and normally open circuit arc sensing means connected in parallel with said second resistor and responsive to an arc for closing said normally open circuit.

15. The invention of claim 11 wherein said arc sensing means is a metal oxide varistor.

* * * * *